United States Patent [19]

Nightingale

[11] 4,363,296

[45] Dec. 14, 1982

[54] COMBUSTION CHAMBER PRESSURE TAP

[76] Inventor: James P. Nightingale, 218 Via El Centro, Oceanside, Calif. 92054

[21] Appl. No.: 187,443

[22] Filed: Sep. 15, 1980

[51] Int. Cl.[3] ..... F04B 35/02

[52] U.S. Cl. ..... 123/59 BM; 123/198 C; 123/65 E; 417/493; 417/380

[58] Field of Search ..... 123/65 E, 59 EC, 59 BM, 123/198 C; 417/493, 380

[56] References Cited

U.S. PATENT DOCUMENTS

| | | | |
|---|---|---|---|
| 2,502,989 | 4/1950 | Rathbun | 417/493 |
| 2,873,574 | 2/1959 | Webb | 417/380 |
| 3,002,506 | 10/1961 | Mocarski | 123/DIG. 3 |
| 3,500,635 | 3/1970 | Roper | 123/198 C |
| 4,020,801 | 5/1977 | Jarnuszkiewicz | 123/65 E |
| 4,222,549 | 9/1980 | Lindgren | 417/380 |

*Primary Examiner*—Craig R. Feinberg

*Attorney, Agent, or Firm*—Robert G. Upton

[57] ABSTRACT

A source of gas pressure from an internal combustion engine is made available by tapping off the exhaust products within the combustion chamber, preferably just prior to exhausting the gas out of the engine. A pressure tap fitting communicates with the combustion chamber through the cylinder wall. The opening into the combustion chamber is closed off during most of the stroke of the engine by the skirt of the piston. As the piston, during the power stroke of the engine, is driven down the cylinder wall, the crown of the piston eventually clears the opening in the pressure tap. The exhaust gas, under very high pressure, enters the tap just prior to dumping the exhaust gas through the exhaust ports of the engine. Thus, a useful source of pressure is derived from the engine without affecting the operating efficiency of the engine.

2 Claims, 2 Drawing Figures

COMBUSTION CHAMBER PRESSURE TAP

BACKGROUND OF THE INVENTION

1. Field of the Invention

This invention relates to internal combustion engines and a means to obtain a useful source of gas pressure therefrom.

More particularly, this invention teaches a means to tap off a source of gas pressure by utilizing the exhaust gases within a combustion chamber. A small conduit taps off gas pressure just prior to expelling the exhaust products out through the exhaust ports.

2. Description of the Prior Art

Internal combustion engines have been used for a number of years to produce an auxiliary source of pressure for specific purposes. For example, in miniature two-cycle engines, it is well known to utilize crankcase pressure to pressurize fuel tanks and the like. In this state of the art system, as the piston moves down the cylinder wall, air is compressed in the crankcase below the piston. This increased pressure is tapped off through an aperture in the crankcase. The available pressure is used, for example, to pressurize fuel tanks, accumulators for compressed gas actuatable systems and the like. The crankcase pressurization system is disadvantaged in that, as the piston moves up the cylinder walls, the reverse occurs in that a partial vacuum is developed in the crankcase. At best then, the crankcase pressurization system in miniature two-cycle engines is limited in its capacity to about six pounds of pressure. If only positive or or increased pressure is desired, in this system, a one-way valve would have to be incorporated wherein the valve closes off during the upward stroke of the piston.

The present invention teaches a means to provide a positive source of hundreds of pounds of gas pressure from an internal combustion engine without detracting from the performance of the engine in any way.

SUMMARY OF THE INVENTION

An object of this invention is to provide a method and means to provide a positive source of high pressure from an internal combustion engine.

Yet another object of the invention is to tap off a source of pressure from an operating internal combustion engine without compromising the performance of the engine.

Still another object of the invention is to provide a relatively high source of pressure useful in supplying huge amounts of pressure for specific purposes.

An apparatus to obtain a source of gas under high pressure from an operating, piston type internal combustion engine is disclosed. The engine block has at least one cylinder containing a piston connected to the engine block, the piston having a crown at a first end and a skirt portion below the crown terminating at a second end of the piston. A cylinder head is connected to the cylinder. A combustion chamber is formed within the cylinder between the cylinder head and the crown of the piston. At least one exhaust port communicates with the combustion chamber. At least one fuel intake port communicates with the combustion chamber. At least one pressure tap communicates with the combustion chamber through the cylinder positioned between the cylinder head and the exhaust port. An orifice formed in the pressure tap is exposed to the high exhaust gas pressure when the crown of the piston moves past the orifice in the pressure tap. The high pressure gas is directed to pressure accumulation means such as a high pressure storage tank prior to expelling the high pressure exhaust gases through the at least one exhaust port.

An advantage then, over the prior art, is the means in which a high positive pressure source is tapped off from the combustion chamber of an engine prior to exhausting the exhaust gases from an operating engine.

Yet another advantage over the prior art is the utilization of exhaust gas pressure from an internal combustion engine without detracting from the performance of the engine.

The above noted objects and advantages of the present invention will be more fully understood upon a study of the following detailed description in conjunction with the detailed drawings.

DESCRIPTION OF THE PREFERRED EMBODIMENTS AND BEST MODE OF OPERATION OF THE INVENTION

Figure 1:
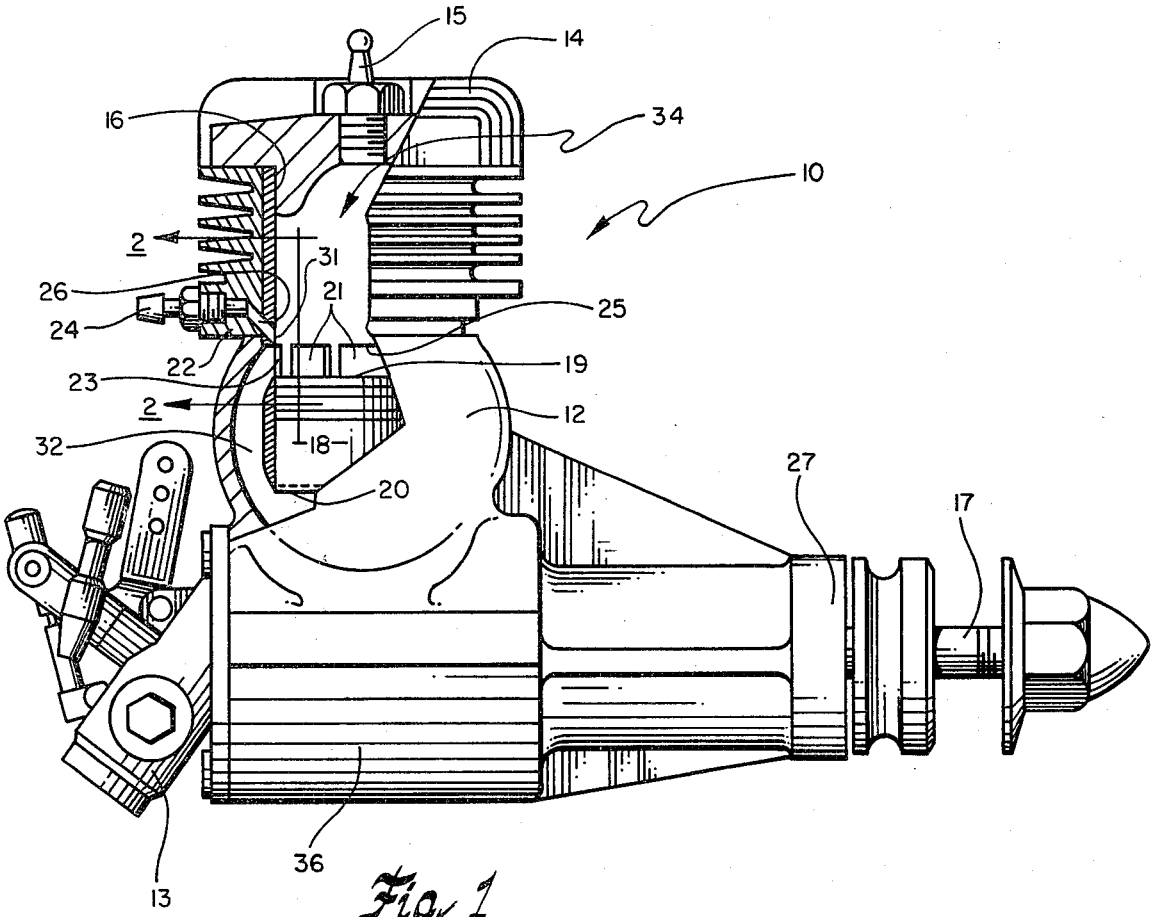
FIG. 1 is a partially cutaway cross-section of a miniature two cycle engine illustrating the pressure tap off of the present invention.

Turning now to FIG. 1, the miniature internal combustion engine generally designated as 10 consists of a crankcase housing or engine block 12 with a cylinder head 14 and piston sleeve 16 attached thereto. A combustion chamber 34 is formed between the cylinder head 14 and piston crown 19 of piston 18. One or more exhaust gas exhaust ports 21 formed in sleeve 16 direct exhaust gases out of the engine at the end of each power stroke of the engine.

Fuel is directed into the engine 10 through a carburetor 13 into lower crankcase 36. Fuel enters fuel intake passage 32 and from there to the combustion chamber 34 through fuel intake ports 23 (see also FIG. 2).

Figure 2:
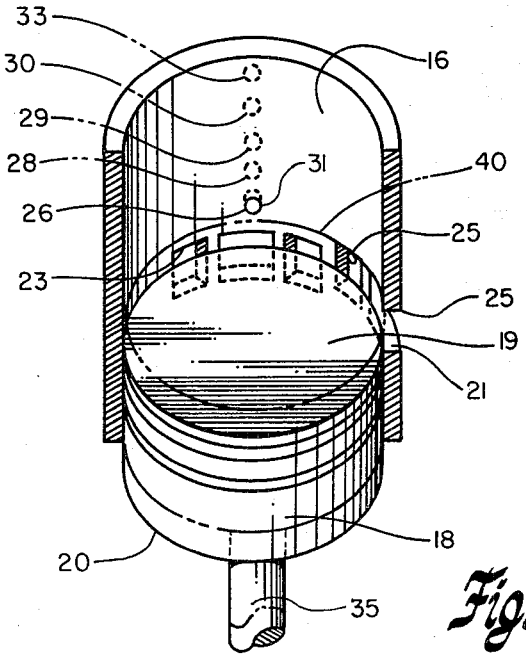
FIG. 2 is a section taken through 2—2 of FIG. 1 illustrating the relative position of the pressure tap orifice within the combustion chamber as well as alternate positions of the pressure tap.

A pressure tap boss 22 is formed in crankcase housing 12. The boss receives a pressure tap fitting 24. An orifice or conduit 26 formed in housing 12 and sleeve 16 communicate with the combustion chamber 34, and the pressure fitting 24. Exhaust gas pressure enters orifice 26 when the crown 19 of piston 18 moves past the orifice opening 31 during the downward or power stroke of the engine 10. Exhaust gas under very high pressure then is preferrably directed into orifice 26 just prior to dumping of the exhaust gas out through exhaust ports 21. This relationship is shown in FIG. 2. The crown 19 of piston 18, as indicated in the phantom piston position 40, is just clearing opening 31 in sleeve 16 admitting high pressure exhaust gas through pressure fitting 24 while exhaust ports 21 are still closed off by the piston skirt or side wall. By tapping off exhaust gas pressure just prior to dumping of the gas through ports 21, no engine performance is lost through compression leakage through orifice 26 since the power stroke of the engine is essentially completed when the pressure is diverted through pressure tap fitting 24.

Obviously, the opening 31 in sleeve 16 could be positioned closer to cylinder head 14 as shown in the phantom alternate opening positions 28, 29, 30 and 33. While the exhaust gas pressure within combustion chamber 34 is higher when piston crown 19 is closer to the cylinder head since the chamber volume is less, combustion chamber gas pressure is exposed to a leak path for a longer period of time when, for example, the alternate opening 33 is utilized before the exhaust gases are finally exhausted through ports 21. Thus, it is readily apparent, the preferred pressure tap opening position is as illustrated in FIG. 1 and enumerated as 31. Multiple pressure tap bosses may be provided and one or more pressure taps may be utilized during operation of the engine (not shown).

The tapped off high pressure gas may be directed through a pressure regulator (not shown) where precise pressure regulation is desired. The source of high pressure will find use in a number of well known pneumatic systems. For example, the gas pressure may be accumulated to drive retract systems for retractable landing gears or flaps for aircraft. In addition, the gas pressure may be used to pressurize fuel tanks or the like as previously described.

The pressure available from miniature two-cycle internal combustion engines ranges from a few hundred to several hundred pounds per square inch depending upon where in the combustion chamber the pressure is tapped.

It would additionally be obvious to tap into the combustion chambers of multi-cylinder four stroke or four cycle internal combustion engines such as automobile engines (not shown). The accumulated gas could, for example, be used to drive windshield wipers and power brake systems to name but a few uses of gas under pressure.

It will of course be realized that various modifications can be made in the design and operation of the present invention without departing from the spirit thereof. Thus, while the principal preferred construction and mode of operation of the invention have been explained in what is now considered to represent its best embodiments has been illustrated and described, it should be understood that within the scope of the appended claims, the invention may be practiced otherwise than as specifically illustrated and described.

I claim:

1. An apparatus to obtain a source of gas under high pressure from an operating, piston type internal combustion engine comprising:

an engine block, at least one cylinder containing a piston connected to said engine block, said piston having a crown at a first end and a skirt portion below said crown terminating at a second end of said piston, at least one cylinder head connected to said cylinder, a combustion chamber formed within said cylinder between said cylinder head and said crown of said piston, at least one exhaust port being downwardly spaced from said cylinder head and communicating with said combustion chamber through said cylinder, at least one fuel intake port communicating with said combustion chamber through said cylinder, at least one pressure tap orifice formed in said at least one cylinder communicating with said combustion chamber positioned immediately above said exhaust port between said cylinder head and said exhaust port, said pressure tap orifice being exposed to said high exhaust gas pressure when said crown of said piston moves past said orifice when said piston is substantially at the end of its power stroke, said high pressure gas being directed to pressure accumulation means just prior to expelling said high pressure exhaust gases through said at least one exhaust port.

2. The invention as set forth in claim 1 wherein said internal combustion engine is a miniature piston type two-cycle engine.

* * * * *